United States Patent [19]

Rademacher et al.

[11] Patent Number: 4,991,374

[45] Date of Patent: Feb. 12, 1991

[54] PACKAGING MACHINE FOR SLIDE-FASTENER MANUFACTURE

[75] Inventors: Werner Rademacher, Essen-Kettwig; Franz Hochlehnert, Essen; Jörg Geiger, Oberhausen; Frank Kuhnke, Essen; Kurt Scheid, Dorsten; Werner Schulz, Essen, all of Fed. Rep. of Germany

[73] Assignee: Opti Patent- Forschung-und Fabrikations AG, Riedern-Allmeind, Switzerland

[21] Appl. No.: 387,297

[22] Filed: Jul. 28, 1989

[30] Foreign Application Priority Data

Jul. 28, 1988 [DE] Fed. Rep. of Germany ..... 3825715

[51] Int. Cl.[5] ..... B65B 27/10; B65B 61/26

[52] U.S. Cl. ..... 53/131; 53/148; 53/540; 53/582; 198/468.11

[58] Field of Search ..... 53/131, 148, 540, 531, 53/582; 198/468.01, 468.1, 468.11

[56] References Cited

U.S. PATENT DOCUMENTS

| | | | |
|---|---|---|---|
| 3,314,521 | 4/1967 | Hollenton | 53/148 |
| 3,453,167 | 7/1969 | Arvidson | 198/468.1 |
| 4,164,278 | 8/1979 | Gurioli | 198/468.1 |

FOREIGN PATENT DOCUMENTS 2154548 5/1973 Fed. Rep. of Germany .

*Primary Examiner*—John Sipos

*Attorney, Agent, or Firm*—Herbert Dubno; Andrew M. Wilford

[57] ABSTRACT

An apparatus for packing slide fasteners as they arrive in a longitudinal transport direction one after the other at a predetermined travel speed from a production facility has a speedup conveyor receiving the arriving slide fasteners and operating at a speed substantially higher than the travel speed thereof and a separating conveyor running transversely of the speedup conveyor and having an upstream end receiving the fasteners from the speedup conveyor and a downstream end transversely offset therefrom. A collection trough having a floor inclined to the horizontal, upper and lower ends, and a plate blocking the lower end is positioned underneath the separating conveyor to receive the fasteners therefrom and a downstream trough is aligned longitudinally with and has an upstream end separated by a space from the collection trough, a floor formed with a throughgoing aperture, and a downstream end. A collection vessel is provided underneath the downstream end of the downstream trough. A transport device has an upstream arm engageable in the collection trough at the lower end thereof and a downstream arm engageable in the space and downstream trough for displacing both of these arms between upstream and downstream positions for pushing respective bundles of the fasteners downstream. A packing unit in the space between the troughs applies a wrapping to the bundles thereat and a labeling unit underneath the aperture prints indicia on the wrappings as same pass the aperture.

8 Claims, 1 Drawing Sheet

1
2
3
4
5
6
7
9
10
11
12
13
14
15
16
17
18
19
20
21
24
25
D 1
2
3
4
5
6
7
8
9
10
11
13
14
16
20
22
23
24
D
CONTROLLER

PACKAGING MACHINE FOR SLIDE-FASTENER MANUFACTURE

FIELD OF THE INVENTION

The present invention relates to the manufacture of slide fasteners. More particularly this invention concerns a system for packaging finished slide fasteners.

BACKGROUND OF THE INVENTION

A slide fastener typically is formed by a pair of longitudinally extending and parallel textile tapes having confronting edges that carry interleavable coupling elements. These elements, which are typically made of a synthetic-resin coiled or meandered monofilament, do not extend the full length of the respective tapes and are joined together at their one ends by a so-called bottom end stop and each carry at their opposite ends a so-called top stop. A slide can move along both elements and is constructed such that on longitudinal movement from the bottom stop toward the top stops it interleaves, that is joins, the two coupling elements, and on opposite movement it separates them.

Such fasteners are made as described in commonly assigned and copending patent application in a mass-production operation starting from a basic workpiece comprised of two very long parallel tapes whose confronting edges carry full-length coupling elements that are usually joined together. In a first machine a gap is formed in the joined coupling elements, same being cut away or otherwise removed for short distances at locations spaced along the tapes by the length of the fasteners to be made. Then the bottom end stops are fitted to the joined coupling elements at what is normally relative to the direction of travel of the tapes the trailing edges of each gap. A slider is then fitted to the elements from the leading edge of each gap, being slid on in a direction tending to separate the elements. Subsequently the top stops are applied to the separated coupling elements immediately downstream of the slider at the leading end of each gap. The tapes then are cut transversely across generally through the center of the gap, separating out the individual fasteners. Finally the individual slide fasteners are bundled together, provided with some sort of wrapping, and labeled for sale.

As described in German patent document No. 2,154,548 filed 03 Nov. 1971 the fasteners are delivered longitudinally one after the other to the packing machine whose input is constituted by a speedup conveyor running at a speed that is many times faster than the arrival speed of the fasteners. This multiplies the travel speed of the fasteners and delivers them to a crosswise bundling conveyor which runs continuously in a direction perpendicular to the longitudinal direction the fasteners are moving in as they arrive. The crosswise conveyor therefore moves the fasteners transversely so that they bunch up in a pile against a stop plate. A counter on the crosswise conveyor lifts the stop plate when a predetermined number of the fasteners have been stacked against it so that this bunch can be dropped onto a table where they are wrapped, labeled, and otherwise prepared for shipment in a manual process.

Such a procedure has several manual steps and is therefore not efficient enough to produce packs of the fasteners cost efficiently.

OBJECTS OF THE INVENTION

It is therefore an object of the present invention to provide an improved system for packing slide fasteners.

Another object is the provision of such an improved system for packing slide fasteners which overcomes the above-given disadvantages, that is which operates wholly automatically from forming bundles of the fasteners through wrapping and labeling them.

SUMMARY OF THE INVENTION

An apparatus for packing slide fasteners as they arrive in a longitudinal transport direction one after the other at a predetermined travel speed from a production facility has a speedup conveyor receiving the arriving slide fasteners and operating at a speed substantially higher than the travel speed thereof and a separating conveyor running transversely of the speedup conveyor and having an upstream end receiving the fasteners from the speedup conveyor and a downstream end transversely offset therefrom. According to this invention a collection trough having a floor inclined to the horizontal, upper and lower ends, and a plate blocking the lower end is positioned underneath the separating conveyor to receive the fasteners therefrom and a downstream trough is aligned longitudinally with and has an upstream end separated by a space from the collection trough, a floor formed with a throughgoing aperture, and a downstream end. A collection vessel is provided underneath the downstream end of the downstream trough. A transport device has an upstream arm engageable in the collection trough at the lower end thereof and a downstream arm engageable in the space and downstream trough for displacing both of these arms between upstream and downstream positions for pushing respective bundles of the fasteners downstream. A packing unit in the space between the troughs applies a wrapping to the bundles thereat and a labeling unit underneath the aperture prints indicia on the wrappings as same pass the aperture.

With this system it is therefore possible to completely automate the bundling, labeling, and packing steps. The machine can keep up with a very fast cutting unit and will at the same time work perfectly without adjustment with a slower unit or one that stops occasionally.

In accordance with a further feature of this invention the labeling unit includes an ink-jet printer head aligned with the aperture. This makes it very easy by a simple programming step to change the label, and also means that the labeling will be done very quickly, even on a workpiece moving rapidly past the aperture.

The plate at the lower end of the collection trough is according to this invention vertically displaceable synchronously with the upstream arm to provide access for same to the collection trough. Thus once a counter provided in a controller of this arrangement determines that the desired number of fasteners has been dropped into the collection trough, the plate against which they have slid by the force of gravity is lifted and the upstream arm engages them to push then down so they bridge the space and can be wrapped.

The downstream trough of this invention includes a conveyor trough formed with the aperture and a movable output trough overlapping the conveyor trough and emptying into the vessel. Thus the wrapped and labeled bundles of fasteners are distributed into the vessel evenly.

Although it is within the scope of this invention for the packing means to put the groups or stacks of fasteners in bags or completely wrap them, according to this invention it only wraps a tape around the bundles in the space. This is extremely efficient packaging that holds the fasteners well but is still easy to remove.

In accordance with another feature of this invention the downstream transport arm is provided with a suction lifter engageable with the wrapping of the bundle in the downstream trough. The lifting of the bundle by this lifter can be synchronized with the application of the labeling by the printer so that the printing is not smeared by subsequent transport.

DESCRIPTION OF THE DRAWING

The above and other objects, features, and advantages will become more readily apparent from the following, reference being made to the accompanying drawing in which.

SPECIFIC DESCRIPTION

Figure 1:
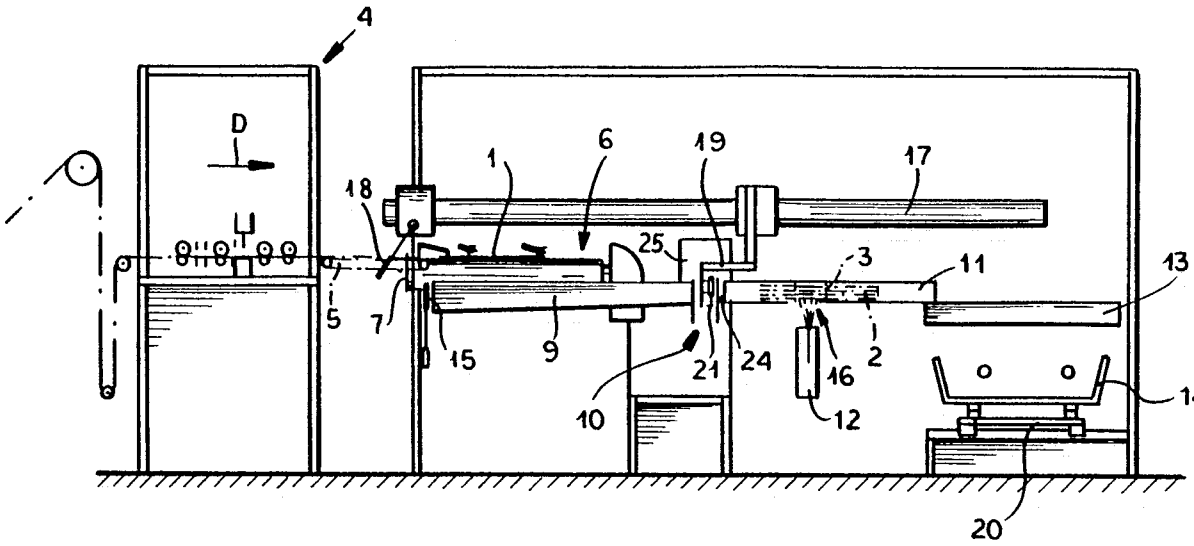
FIG. 1 is a side view of the apparatus according to this invention.
Figure 2:
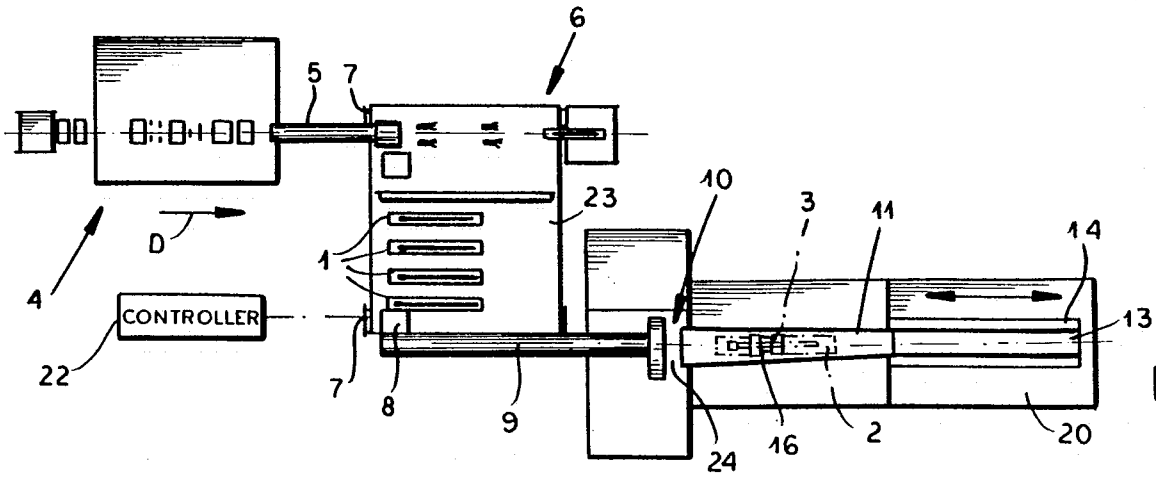
FIG. 2 is a top view of the apparatus.

As seen in FIGS. 1 and 2 a succession of complete slide fasteners 1 are delivered at a relatively low transport speed in a direction D from a cutting device 4 to a speedup conveyor 5 that operates in the direction D at a much higher speed. The thus accelerated fasteners 1 are delivered by the speedup conveyor 5 to a crosswise separating conveyor 6 constituted by a broad belt 23 spanned over a pair of rolls 7 rotating about axes parallel to the direction D. In this manner the fasteners 1 are delivered to the downstream (down in FIG. 2) end of the conveyor 6 one after another while still extending parallel to the direction D. The conveyor 6 is slotted as described in the above-cited German patent document and is provided at its downstream end with a counter 8 that reports to a controller 22 the number of fasteners 1 that pass this downstream end.

Immediately below the downstream end of the conveyor 6 is a collection trough 9 whose floor is tilted substantially to the horizontal as seen in FIG. 1 and whose lower end (the upstream end seen on the left in FIGS. 1 and 2) is normally blocked by a plate 15 that can be lowered from the illustrated position by the controller 22. Thus as the fasteners 1 are dropped off the conveyor 6 they will fall into the trough 9 and will bunch up in a bundle 2 at the lower upstream end thereof.

A packing machine 10 downstream of the collection trough 9 comprises a level conveyor trough 11 aligned with but spaced longitudinally by a spacing 24 from the upper downstream end of the collection trough 9 and an output trough 13 arranged above a packing container 14 and itself is arranged downstream and slightly below the downstream end of the conveyor trough 11. In the gap 24 between the troughs 9 and 11 a wrapping unit 25 that can apply a tape or belt band 3 around a bundle 2 of the fasteners 1. The trough 11 is formed in its floor with an aperture or window 16 through which a printer 12 can apply indicia to the belt 3. This labeler 12 is a simple ink-jet printer head.

A conveying device 17 movable in the direction D has at its upstream end an arm 18 that can reach into the trough 9 and in its middle an arm 19 that can reach into the space 24 and trough 11 and that is provided with a suction lifter 21. These arms 18 and 19 can shift bundles 2 of the fasteners 1 downstream when the conveying device 17 moves through a stroke equal to the distance between the arms 18 and 19.

According to this invention the conveyor 6 operates until the counter 8 ascertains that the desired number of the fasteners 1 has been dropped into the trough 9. Then the controller 22 momentarily stops conveyor 6 and cutter 4 and lowers the end plate 15 so that the arm 18 can be lowered into the trough 9 to push the bundle 2 along until its upstream end is just past the upstream end of the gap 24, where in FIG. 1 the arm 19 is illustrated. The packing machine 25 then wraps a tape 3 around it and the arm 18 and plate 15 are lifted and the conveyor 6 and cutter 5 are restarted. With the next cycle as the next bundle 2 is being pushed downstream by the arm 18, the previously wrapped bundle 2 is engaged by the arm 19 and raised slightly by its suction lifter 21 and transported downstream, being printed by the device 12 as it passes the window 16 and being pushed into the trough 13. The packing container 14 is moved back and forth as indicated by the double-headed arrow to distribute the thus wrapped and printed packs of fasteners 1.

Thus with this system the entire operation of forming up bundles of the fasteners, wrapping them, and printing them is carried out automatically. The equipment is extremely simple and can keep up with a fast production line easily.

We claim:

1. An apparatus for packing slide fasteners as they arrive in a longitudinal transport direction one after the other at a predetermined travel speed from a production facility, the apparatus comprising:

a speedup conveyor receiving the arriving slide fasteners and operating at a speed substantially higher than the travel speed thereof;

a separating conveyor running transversely of the speedup conveyor and having an upstream end receiving the fasteners from the speedup conveyor and a downstream end transversely offset therefrom;

a collection trough having a floor inclined to the horizontal, upper and lower ends, and a plate blocking the lower end, the collection trough being positioned underneath the separating conveyor to receive the fasteners therefrom;

a downstream trough aligned longitudinally with and having an upstream end separated by a space from the collection trough, a floor formed with a throughgoing aperture, and a downstream end;

a collection vessel underneath the downstream end of the downstream trough;

transport means having an upstream arm engageable in the collection trough at the lower end thereof and a downstream arm engageable in the space and downstream trough for displacing both of these arms between upstream and downstream positions for pushing respective bundles of the fasteners downstream;

packing means in the space between the troughs for applying a wrapping to the bundles thereat; and labeling means underneath the aperture for labeling the wrappings as same pass the aperture.

2. The apparatus defined in claim 1 wherein the labeling means includes an ink-jet printer head aligned with the aperture.

3. The apparatus defined in claim 1 wherein the plate at the lower end of the collection trough is vertically displaceable synchronously with the upstream arm to provide access for same to the collection trough.

4. The apparatus defined in claim 1 wherein the downstream trough includes a conveyor trough formed with the aperture and a movable output trough overlapping the conveyor trough and emptying into the vessel.

5. The apparatus defined in claim 1 wherein the packing means wraps a tape around the bundle in the space.

6. The apparatus defined in claim 1 wherein the downstream transport arm is provided with a suction lifter engageable with the wrapping of the bundle in the downstream trough.

7. The apparatus defined in claim 1, further comprising control means connected to the conveyors and other means for synchronously operating same.

8. The apparatus defined in claim 7 wherein the control means includes a counter between the ends of the separating conveyor.

* * * * *